United States Patent [19]

Kubota et al.

[11] Patent Number: 4,848,603

[45] Date of Patent: Jul. 18, 1989

[54] HOLDING FURNACE OF CONSTANT MOLTEN METAL LEVEL

[75] Inventors: Shoko Kubota; Sadayoshi Yamada, both of Zama, Japan

[73] Assignee: Toshiba Machine Co., Ltd., Tokyo, Japan

[21] Appl. No.: 198,974

[22] Filed: May 26, 1988

[30] Foreign Application Priority Data

May 28, 1987 [JP] Japan ..... 62-129775
May 28, 1987 [JP] Japan ..... 62-129777

[51] Int. Cl.[4] ..... B22D 17/32

[52] U.S. Cl. ..... 222/595; 164/155; 164/156; 164/147.1; 222/594

[58] Field of Search ..... 164/155, 156, 500, 147.1, 164/457; 222/595, 594, 591

[56] References Cited

U.S. PATENT DOCUMENTS 3,504,825 4/1970 Diamond et al. ..... 164/156 X
3,510,116 5/1970 Harvill et al. ..... 222/595 X
3,844,453 10/1974 Eickelberg ..... 222/595
4,714,102 12/1987 Koya ..... 164/156 X

FOREIGN PATENT DOCUMENTS 48-14291 5/1973 Japan ..... 164/156
56-26509 6/1981 Japan .
57-19148 2/1982 Japan .
59-127967 7/1984 Japan ..... 164/500

*Primary Examiner*—Nicholas P. Godici
*Assistant Examiner*—J. Reed Batten, Jr.
*Attorney, Agent, or Firm*—Helfgott & Karas

[57] ABSTRACT

A pressurized holding furnace having an open feeding chamber is provided with a pressure chamber having a pressure device for pressurizing the pressure chamber and a discharge device for releasing the pressure. The pressure chamber is provided at a lower position than the lowest level of the molten metal in the pressure chamber with an inlet port of a feeding pipe and at a higher position than the highest level of the molten metal in the pressure chamber with an electromagnetic pump.

9 Claims, 3 Drawing Sheets

HOLDING FURNACE OF CONSTANT MOLTEN METAL LEVEL

FIELD OF THE INVENTION

This invention relates to a holding furnace for storing the molten metal to be fed into a die-cast machine or the like, particularly to a holding furnace of constant molten metal level capable of keeping a constant level of the molten metal in the feeding chamber and/or the discharge chamber.

BACKGROUND OF THE INVENTION

Generally in the die-casting art, it is essential to accurately control the feeding amount of the molten metal in order to improve a quality of castings and an efficiency of operation.

The fluctuation of the feeding amount of the molten metal depends on that of a suction head of an electromagnetic feed pump for pressurizing the molten metal out, so that it is required to control the capacity of the pump relatively to the fluctuation of the suction head or to maintain the suction head at constant in disregard of the feeding process.

Hithertobefore, the capacity of the pump has been usually controlled by changing the electromagntic voltage or the actuating period of the pump, while in order to maintain the suction head at constant, a complete-closed type furnace has been employed to pressure the whole furnace as predetermined or a half-closed type furnace wherein the feeding chamber and/or the discharge chamber are open has been employed to pressure the whole furnace as predetermined so as to keep the molten metal in the feeding chamber or the discharge chamber at a fixed level.

Each conventional method as above-mentioned, however, had the following disadvantages.

The method for controlling the capacity of the pump is required to operate or compute the electromagnetic voltage or the actuating period of the pump by stages relatively to the fluctuation of the suction head, resulting in a complicated structure. Furthermore, especially when the actuating period is changed, the actuating cycle of the casting process is also changed, thereby lowering the operation efficiency and the quality of castings.

With regard to the method for maintaining the suction head at constant, on the other hand, the complete-closed type furnace has a complicated structure with an inferior maintenance, while the half-closed type furnace has a simpler structure with a comparatively convenient maintenance than the complete-closed type. The half-closed type furnace, however, has a dangerous disadvantage such that the molten metal may overflow from the feeding chamber or the discharge chamber owing to a mis-operation of the apparatus and further it is difficult to accurately keep a level of the molten metal at constant when one shot of the feeding amount is smaller as die-cast machines.

Accordingly, an object of the invention is to solve the above problems and to provide a holding furnace of constant molten metal level capable of precisely and firmly keeping a level of the molten metal without overflow thereof in a half-closed type furnace with a simple structure with a convenient maintenance.

SUMMARY OF THE INVENTION

In order to achieve the above object, the invention provides a holding furnace of constant molten metal level characterized in that a pressurized holding furnace having an open feeding chamber is provided with a pressure chamber having a pressure device for pressurizing said pressure chamber and a discharge device for releasing the pressure, said pressure chamber being provided at a lower position than the lowest level of the molten metal in the pressure chamber with an inlet port of a feeding pipe and at a higher position than the highest level of the molten metal in the pressure chamber with an electromagnetic pump according to the first embodiment, and particularly the pressure gas supply means may preferably comprise a piston pump actuated by means of a hydropneumatic actuator driven through a solenoid valve and the pump capacity is the capacity such that a unit supply quantity of the pressure gas may attain within one stroke of a piston.

According to the second embodiment, a holding furnace of constant molten metal level is characterized in that a pressurized holding furnace having an open discharge chamber is provided in the furnace body with a pressure adjustment means for adjusting the pressure in the furnace body in accordance with supply/discharge operation of a feeding pipe of an electromagnetic pump and further that a joint portion between the discharge chamber and the furnace body is provided with a first overflow means for overflowing the molten metal into the discharge chamber when the pressure is added to the furnace body and a second overflow means for overflowing the molten metal from the discharge chamber when the pressure is released from the furnace body, and particularly a first overflow means may preferably comprise a first weir situated in the discharge chamber which surrounds a first communication hole provided at the bottom portion of a partition wall between the discharge chamber and the furnace body and a second overflow means preferably may comprise a second weir situated in the furnace body which surrounds a second communication hole provided at the bottom portion of a partition wall between the discharge chamber and the furnace body.

For better understanding, the invention will now be described hereinbelow in more detail with reference to the accompanying drawings.

PREFERRED EMBODIMENTS OF THE INVENTION

Figure 1:
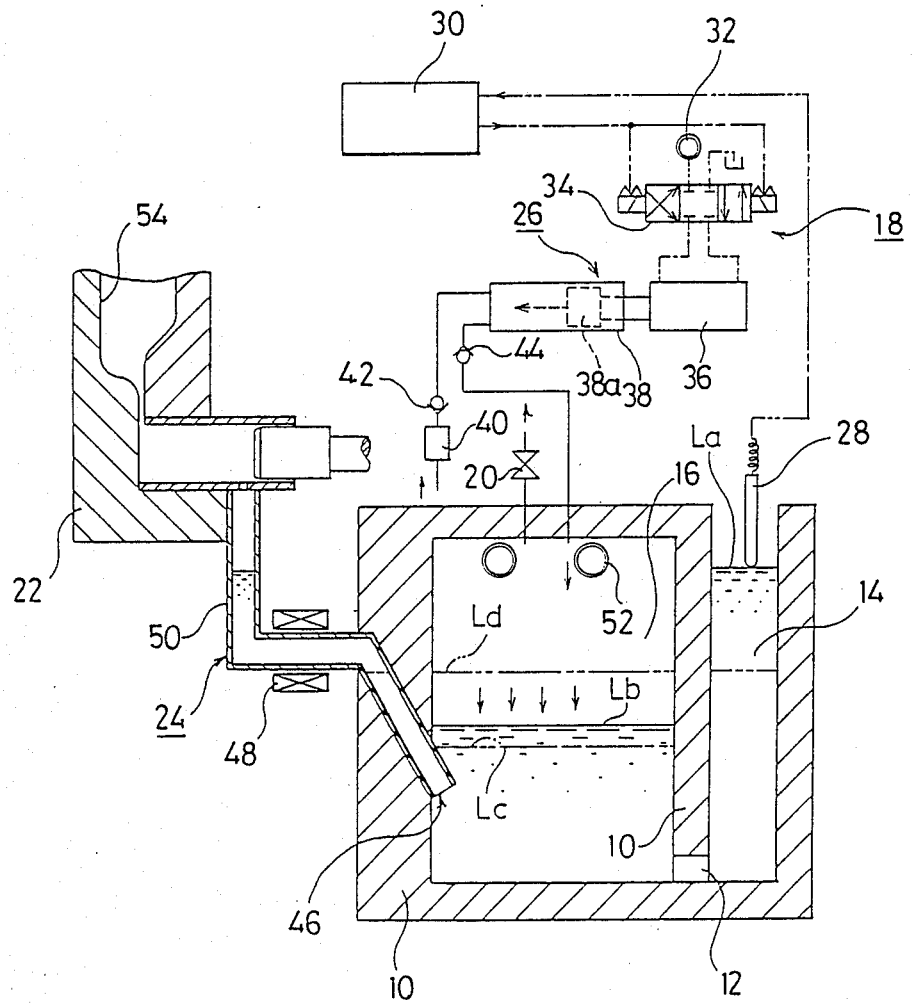
FIG. 1 is a sectional block diagram of the first embodiment of a holding furnace of constant molten metal level according to the invention.

In the first embodiment as shown in FIG. 1, a holding furnace of constant molten metal level basically comprises a closed type furnace body 10 and a feeding chamber 14 with an open upper portion provided through a bottom communication port 12 at the side of the furnace body 10, the upper portion of said furnace body 10 comprising a pressure chamber 16 which is provided with a pressure device 18 and a discharge device 20 and between the furnace body 10 and a die 22 is provided with an electromagnetic feeding pipe 24.

The pressure device 18 comprises a pressure gas supply means 26, a detector 28 and a controller 30, while the pressure gas supply means 26 comprises a pressure source 32, solenoid valve 34, an actuator 36 and a piston pump 38. A suction path of the piston pump 38 is provided with a heat and filtration device 40 and a check valve 42, while a discharge path thereof is provided with a check valve 44. In such a structure, when a fixed level La of the molten metal in the feeding chamber 14 lowers and the detector 28 is apart from a fixed level La, the controller 30 in accordance with a signal transmitted from the detector 28 actuates the solenoid valve 34, so that the actuator 36 pressurizes the piston 38*a* forward to introduce the pressure gas into the pressure chamber 16 by means of the piston pump 38. Consequently, the pressure in the pressure chamber 16 rises to push a level Lb of the molten metal inside the furnace body 10 down, while the level of the molten metal in the feeding chamber 14 conversely rises to return to the above fixed level La to which the detector 28 contacts again to transmit a signal. Then, the controller 30 actuates the solenoid valve 34 in the opposite direction to pull the piston 38*a* back at its original basic position within the piston pump 38 as illustrated in the figure and to stop operation of the pressure gas supply means 26. The discharge device 20, on the other hand, comprises an electromagnetic discharge valve and is preferably openable by a remote control means or the like (not shown).

The inlet port 46 of the electromagnetic pump feeding pipe 24 is situated at a lower position than the lowest level Lc of the molten metal in the pressure chamber 16, while the electromagnetic pump 48 is situated at a higher position than the highest level Ld and the pipe 50 between the the electromagnetic pump 48 and the inlet port 46 is provided so as to slant toward the bottom of the furnace body 10. The molten metal in the pipe 50, though usually arranged at a level La of the molten metal in the feeding chamber 14, lowers to the highest level Ld of the molten metal in the pressure chamber 16 when the discharge valve 20 is opened to release the pressure in the pressure chamber 16. Accordingly, the molten metal within the upper portion of the pipe 50 including the electromagnetic pump 48 is flew backward by its own weight to discharge into the pressure chamber 16 or the furnace body 10.

Furthermore, the pressure chamber 16 is provided with a heat means 52 which is operable by means of a thermostat (not shown) so as to keep the gas of the pressure chamber 16 at a predetermined temperature.

The feeding operation from the electromagnetic pump to the die according to the invention will be hereinafter described. When the molten metal of the feeding chamber 14 is maintained at a preset level La to which the detector 28 connects (shown in FIG. 1), the electromagnetic pump 48 is driven to feed the molten metal of the pressure chamber 16 through the pipe 50 into the cavity 54 of the die 22, while the molten metal in the feeding chamber 14 lowers from the preset level La, so that the detecter 28 is apart therefrom. Thereby, the detector 28 transmits an operation signal to the controller 30 so as to supply a predetermined amount of the pressure gas from the pressure device 18 into the pressure chamber 16 as hereinbefore described. Consequently, the molten metal in the feeding chamber 14 is returned to the preset level La, to which the detector connects once again to stop the drive of the pressure device 18. Under such a stop condition, the piston 38*a* is pulled back to the basic position as shown in the figure.

In this case, according to the invention, a unit amount of the pressure gas predetermined relatively to the fed molten metal is supplied into the pressure chamber 16 through one stroke of the piston 38*a*. The pressure gas is heated nearly the temperature in the pressure chamber 16 by means of the heat and filtration device 40, while the temperature in the pressure chamber 16 is kept at constant through the heat means 52, so that the pressure gas is precisely and steadily fed to return the molten metal in the feeding chamber 14 to the preset level La. Namely, the suction head of the electromagnetic pump 48 is precisely and steadily maintained, resulting in an excellent quantity control. Under this condition the pressure gas supply means 26 is actuated through the solenoid valve 34, the actuator 36 and the piston pump 38, thereby causing no mis-operation.

The discharged molten metal in the pipe 50 is released by remote-controlling the discharge valve 20. In this case, as hereinbefore described, the molten metal in the pipe 50 lowers to the highest level Ld of the molten metal in the pressure chamber 16, where the molten metal in the pipe 50 is swiftely flew backward by its own weight to discharge into the pressure chamber 16. This results in a convenient maintenance or change of the electromagnetic pump which is often required.

Figure 2:
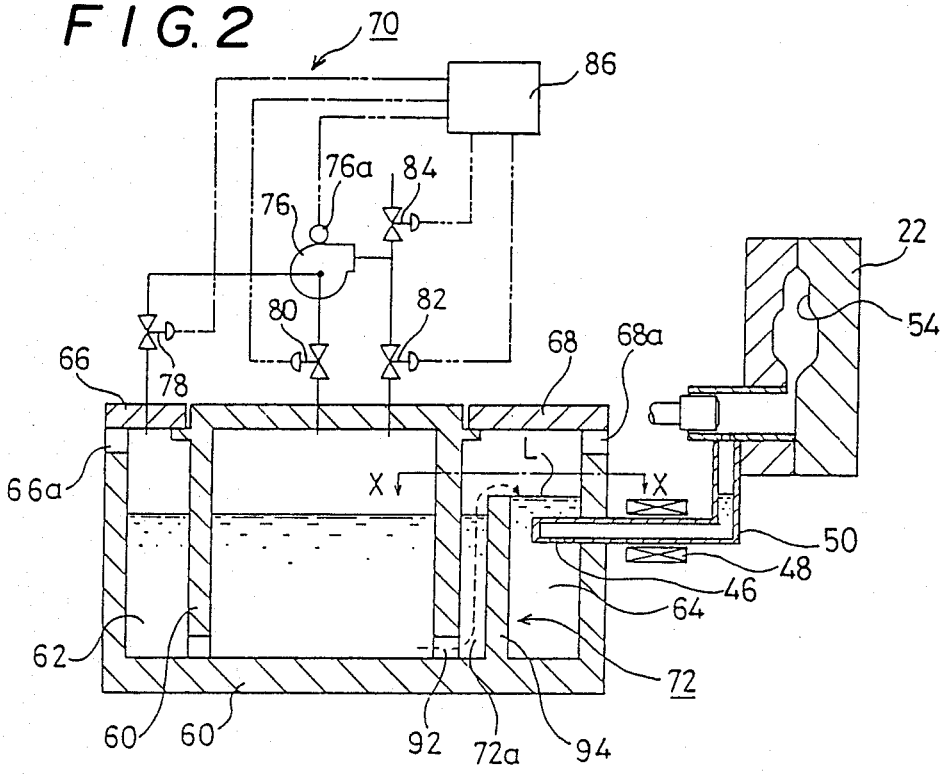
FIG. 2 is a sectional view of the second embodiment of a holding furnace of constant molten metal level according to the invention and taken along Y—Y line of FIG. 3.
Figure 3:
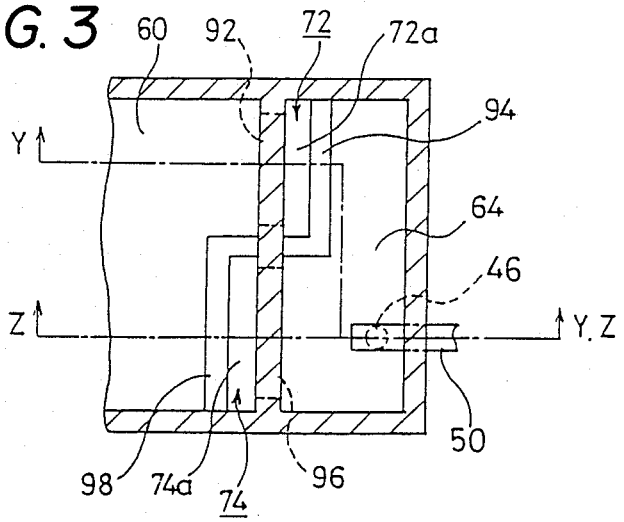
FIG. 3 is a sectional view taken along X—X line of FIG. 2.
Figure 5:
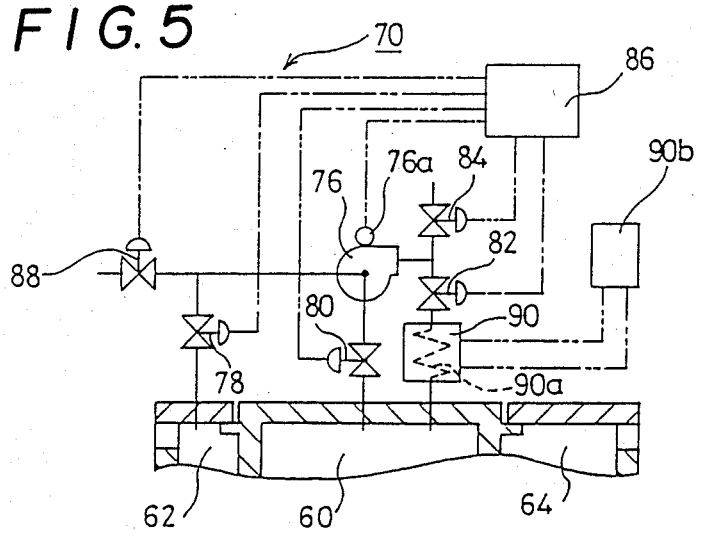
FIG. 5 shows a flow chart of a pressure adjustment means.

The second embodiment according to the invention will be hereinafter described with reference to FIGS. 2 and 5. For convenience, the same structure as the first embodiment shown in FIG. 1 is described with the same reference number.

A holding furance of constant molten metal level according to this embodiment basically comprises a closed type furnace body 60 and a feeding chamber 62 with an open upper portion and a discharge chamber 64 provided at each side of the furnace body 60, said chambers 62 and 64 at their upper portion being provided with thermal covers 66 and 68. The numerical references 66*a* and 68*a* respectively shows atmoshpere release holes in the chambers 62 and 64. The furnace body 60 is provided with a pressure adjustment means 70, while the joint portion between the discharge chamber 64 and the furnace body 60 is provided with a first and a second overflow means 72 and 74.

The pressure adjustment means 70 comprises a ventilator 76, solenoid valves 78 and 80 for switching the inlet port of the ventilator 76 to either of the upper portion of the furnace body 60 or the upper portion of the feeding chamber 62, solenoid valves 82 and 84 for switching the outlet port of the ventilator 76 to the upper portion of the furnace body 60 and/or the open air, and a controller 86 for controlling a drive motor 76*a* and switch valves 78, 80, 82 and 84 of the ventilator 76. Furthermore, the pressure adjustment means 70, as shown in FIG. 5, may be preferably provided with an air inlet port through a switch solenoid valve 88 in the inlet path of the ventilator 76, while the ventilator 76 at the outlet side may be provided with an gas heat device 90, which may have a heat operation device 90*b* with a temperature sensor 90*a*. If thus constructed, the air heated at a high temperature nearly the temperature in the furnace body may be used as a pressure gas source within the furnace body 60 as hereinafter described.

Figure 4:
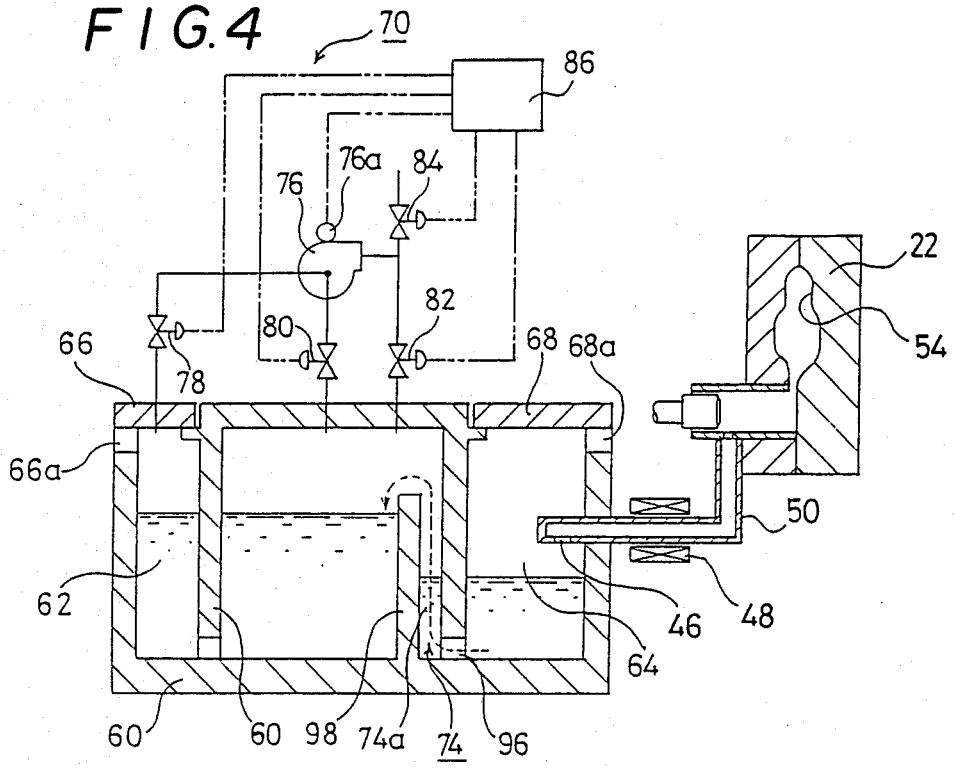
FIG. 4 is a sectional view taken along Z—Z line of FIG. 3.

The first overflow means 72 surrounds a first communication hole 92 provided at the bottom portion of a partition wall between the discharge chamber 64 and the furnace body 60, forming a first weir 94 within the discharge chamber 64, while the second overflow means 74 surrounds a second communication hole 96 provided at the bottom portion of the partition wall, forming a second weir 98 within the furnace body 60. When the inside of the furnace body 60 thus constructed is pressurized, as illustrated by a dashed line in FIG. 2, the molten metal in the furnace body 60 passes the communication hole 92 of the first overflow means 72 and a path 72*a* to overflow the weir 94 into the discharge chamber 64. On the contrary, when the inside of the furnace body 60 is suctioned under the negative pressure as shown in FIG. 4, the molten metal in the discharge chamber 64 passes the communication hole 94 of the second overflow means 74 and a path 74*a* to overflow the weir 98 into the furnace body 60. The overflow means 72 and 74 may be formed by a L-shaped pipe or the like without weir. Furhtermore, the inlet port 46 of the feeding pump pipe 50 is situated at the almost middle height of the discharge chamber 64.

The feeding method according to the invention will be hereinafter described. On feeding, the operation for keeping a level of the molten metal in the discharge chamber 64 at constant is carried out before the feeding operation by means of the electromagnetic pump 48. Namely, simultaneously when the ventilator 76 is driven through the controller 86, each of the switch soneloid valves 78 and 82 is opened to close the valve 80 and 84. Consequently, the inside of the furnace body 60 is pressurized and the molten metal therein overflows the weir 94 of the first overflow means 72 into the discharge chamber 64. Subsequently when the feeding is completed and the level of the molten metal in the discharge chamber 64 is slightly over the weir 94, the ventilator 76 is stopped driving and at the same time the valve 84 is opened, thereby releasing the pressure gas inside the furnace body 60 through the valves 82 and 84 into the open air to flow the molten metal in the discharge chamber 64 over the weir 94 backward into the furnace body 60. Namely, the level of the molten metal in the discharge chamber 64 is kept at the basic level L controlled by the weir 94. FIG. 2 shows a state maintained at this basic level L. In this case, the pressure inside the furnace body 60 is carried out by the gas inside the feeding chamber 62 of high temperature nearly the temperature in the furnace body 60, resulting in a prevention of the pressure fluctuation caused by expansion of the pressure gas to precisely set the basic level L. The pressure adjustment means 70, if provided with a gas heat device 90, may precisely meet the temperature of the pressure gas with that inside the furnace body 60 and further use the open air as a pressure gas. When the operation for keeping the basic level L is completed, the molten metal in the furnace body 60 is reduced by a fixed quantity corresponding to the amount fed into the discharge chamber 64 or one unit fed into the diecast machine, which is supplied through the feeding chamber 62 when the electromagnetic pump is not actuated. Accordingly, the operation for keeping the basic levle L before every feeding operation is always smoothly carried out under a preset condition relatively to the molten metal. Moreover, the pressure adjustment means 70 requires no detector and the temperature of the pressure gas is nearly the temperature in the furnace, thereby attaining an excellent maintenance at the basic level L.

The feeding operation is carried out by driving the electromagnetic pump 48 with a fixed discharge amount for a preset period. In this case, the basic level L in the discharge chamber 64 is precisely kept at a fixed level, so that the molten metal fed into the cavity 54 of the die 22 is correctly controlled with regard to the capacity.

When the residual molten metal in the pipe 50 is discharged as shown in FIG. 4, the controller 86 drives the ventilator 76 and opens the solenoid valves 80 and 84 to close the valves 78 and 82. Thereby, the gas inside the furnace body 60 through the ventilator 76 is suctioned, so that the furnace body 60 is under the negative pressure, while the molten metal in the discharge chamber 64 overflows the weir 98 of the second overflow means into the furnace body 60. When a level of the molten metal in the discharge chamber 64 lowers below the inlet port 46, the residual molten metal in the pipe 50 is automatically discharged into the discharge chamber 64 by its own weight. FIG. 4 shows the state wherein the residual molten metal is discharged, the ventilator 76 is stopped driving, the solenoid valves 82 and 84 are opened and the molten metal in the discharge chamber 64 and that of the path 74*a* are kept at the same level. Thus, the residual molten metal in the pipe 50 may be automatically and by remote control discharged through the controller 86.

From the foregoing, a holding furnace according to the invention may correctly and firmly keep the molten metal at a predetermined level. Furthermore, the holding furnace also has a great advantage of automatically flowing the residual molten metal in the pipe backward by its own weight to discharge into the furnace.

A holding furnace of constant molten metal level according to the invention may correctly and firmly keep the molten metal at a predetermined level with a half-closed type furnace. Therefore, it provides a furnace of comparatively simple structure of light weight with a advantage of a convenient maintenance, resulting in a high quality of die-castings and an excellent operation efficiency.

Although the invention has been described hereinabove with its preferred embodiments, many variations and modifications may be made with keeping several advantages as shown hereinabove but without departing from the scope and spirit of the invention. Furthermore, the invention may be applicable not only to die-cast machines but also to other similar apparatus.

What is claimed is:

1. A holding furnace of constant molten metal level comprising a pressurized holding furnace having an open feeding chamber a pressure chamber containing molten metal and having a pressure device for pressurizing said pressure chamber, and a discharge device for releasing pressure in the pressure chamber, said pressure chamber being provided at a lower position than the lowest level of the molten metal in the pressure chamber with an inlet port of a feeding pipe and at a higher position than the highest level of the molten metal in the pressure chamber with an electromagnetic pump.

2. A holding furnace according to claim 1, wherein the pressure device comprises a means for supplying a pressure gas into the pressure chamber, a detector for detecting a level of the molten metal in the feeding chamber and a controller for actuating said pressure gas supplying means in accordance with a signal transmitted from said detector.

3. A holding furnace according to claim 2, wherein the pressure gas supplying means comprises a piston pump actuated by means of a hydropneumatic actuator driven through a solenoid valve, and the piston pump having such capacity that a unit supply quantity of the pressure gas may attain within one stroke of a piston.

4. A holding furnace according to claim 1, wherein the pressure chamber is provided with a heat means for maintaining the temperature of the pressure gas in the pressure chamber constant.

5. A holding furnace according to claim 1, wherein at an inlet port of the pressure gas supplying means are provided heat means and filtration means.

6. A holding furnace of constant molten metal level comprising a pressurized holding furnace having a furnace body, a discharge chamber provided at the furnace body and being open to the atmosphere, and a pressure adjustment means provided to the furnnace body for adjusting pressure in the furnace body in accordance with supply/discharge operation of a feeding pipe of an electromagnetic pump and wherein a joint portion between the discharge chamber and the furnace body is provided with a first overflow means for overflowing molten metal into the discharge chamber when the pressure is added to the furnace body and a second overflow means for overflowing the molten metal in the discharge chamber when the pressure is released from the furnace body to thereby control and maintain a constant feeding quantity of a molten metal in the furnace body.

7. A holding furnace according to claim 6, wherein the pressure adjustment means comprises a ventilator, a switch valve means for switching an inlet port of the ventilator to either of an upper space of the furnace body, an upper space of a feeding chamber or open air, a switch valve means for switching an outlet port of the ventilator to either of an upper space of the furnace body or the open air, and a controller for controlling a ventilator drive monitor and the switch valve means.

8. A holding furnace according to claim 7, wherein a gas heat means is provided in a ventilating path of the ventilator.

9. A holding furnace according to claim 6, wherein the first overflow means comprises a first weir situated in the discharge chamber which surrounds a first communication hole provided at a bottom portion of a partition wall between the discharge chamber and the furnace body and the second overflow means comprises a second weir situated in the furnace body which surrounds a second communication hole provided at the bottom portion of the partition wall between the discharge chamber and the furnace body.

* * * * *